US011208866B2

(12) United States Patent
Vasques et al.

(10) Patent No.: US 11,208,866 B2
(45) Date of Patent: Dec. 28, 2021

(54) ANNULAR BARRIER

(71) Applicant: WELLTEC OILFIELD SOLUTIONS AG, Zug (CH)

(72) Inventors: Ricardo Reves Vasques, Zug (CH); Satish Kumar, Zug (CH)

(73) Assignee: WELLTEC OILFIELD SOLUTIONS AG, Zug (CH)

( * ) Notice: Subject to any disclaimer, the term of this patent is extended or adjusted under 35 U.S.C. 154(b) by 37 days.

(21) Appl. No.: 16/666,738

(22) Filed: Oct. 29, 2019

(65) Prior Publication Data

US 2020/0131881 A1 Apr. 30, 2020

(30) Foreign Application Priority Data

Oct. 30, 2018 (EP) ..... 18203278

(51) Int. Cl.
*E21B 33/124* (2006.01)
*E21B 33/128* (2006.01)

(52) U.S. Cl.
CPC ..... *E21B 33/128* (2013.01); *E21B 33/1243* (2013.01)

(58) Field of Classification Search
CPC ..... E21B 33/128; E21B 33/1243
See application file for complete search history.

(56) References Cited

U.S. PATENT DOCUMENTS

2002/0166672 A1* 11/2002 White ..... E21B 33/1212 166/387
2004/0055758 A1 3/2004 Brezinski et al.
2006/0186602 A1* 8/2006 Martin ..... F16L 23/18 277/338
2007/0199693 A1 8/2007 Kunz
2017/0145797 A1* 5/2017 Stam ..... E21B 23/01

FOREIGN PATENT DOCUMENTS

| | | |
|---|---|---|
| EP | 2 479 376 | 7/2012 |
| EP | 2 644 821 | 10/2013 |
| WO | 01/92682 | 12/2001 |
| WO | 2005/022012 | 3/2005 |

OTHER PUBLICATIONS

Extended Search Report for EP18203278, dated Apr. 10, 2019, 7 pages.

* cited by examiner

*Primary Examiner* — Taras P Bemko
(74) *Attorney, Agent, or Firm* — Nixon & Vanderhye P.C.

(57) ABSTRACT

An annular barrier configured to be arranged on an outer face of a well tubular metal structure for providing zonal isolation in an annulus downhole, includes an annular space defined by a first expandable metal sleeve part and a second expandable metal sleeve part. The first expandable metal sleeve part having an outer face configured to face away from the outer face of the well tubular metal structure and the second expandable metal sleeve part having an outer face configured to face the outer face of the well tubular metal structure when arranged around the well tubular metal structure. The annular barrier further includes a first inner annular sealing element arranged on the outer face of the second expandable metal sleeve part configured to seal between the second expandable metal sleeve part and the well tubular metal structure.

16 Claims, 10 Drawing Sheets

ANNULAR BARRIER

Figure 1A:
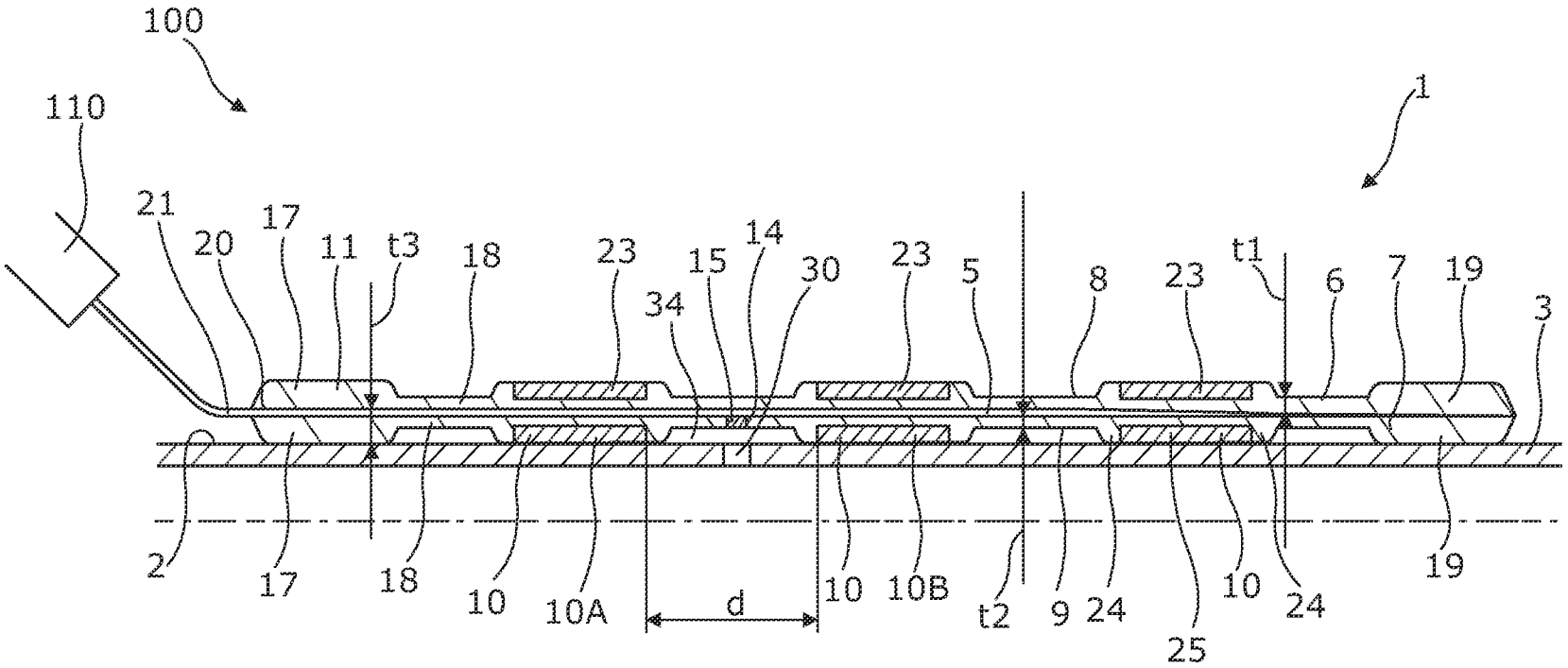

This application claims priority to EP Patent Application No. 18203278.9 filed 30 Oct. 2018, the entire contents of which is hereby incorporated by reference.

The present invention relates to an annular barrier configured to be arranged on an outer face of a well tubular metal structure for providing zonal isolation in an annulus downhole. The invention also relates to a downhole system and a method of arranging an annular barrier on the outer face of the well tubular metal structure mounted from tubing parts or a joint for providing zonal isolation in an annulus downhole.

Annular barriers are arranged as part of a well tubular metal structure downhole for providing zonal isolation between the well tubular metal structure and the borehole or another well tubular metal structure. A metal annular barrier comprises an expandable metal sleeve which is mounted on the outer face of the well tubular metal structure by welding the ends of the expandable metal sleeve directly onto the outer face of the well tubular metal structure or by welding a ring onto the well tubular metal structure and crimp the expandable metal sleeve onto the ring. However, when welding there is a risk of changing the material properties of the well tubular metal structure or the material properties of the expandable metal sleeve, so that the welding process causes a leakage when expanding the annular barrier by pressurising the annular barrier from within.

It is an object of the present invention to wholly or partly overcome the above disadvantages and drawbacks of the prior art. More specifically, it is an object to provide an improved annular barrier which avoids the risk of the welding process damaging the sealing ability of the annular barrier.

The above objects, together with numerous other objects, advantages and features, which will become evident from the below description, are accomplished by a solution in accordance with the present invention by an annular barrier configured to be arranged on an outer face of a well tubular metal structure for providing zonal isolation in an annulus downhole, comprising:

an annular space defined by a first expandable metal sleeve part and a second expandable metal sleeve part, the first expandable metal sleeve part having an outer face configured to face away from the outer face of the well tubular metal structure and the second expandable metal sleeve part having an outer face configured to face the outer face of the well tubular metal structure when arranged around the well tubular metal structure, wherein the annular barrier further comprises a first inner annular sealing element arranged on the outer face of the second expandable metal sleeve part configured to seal between the second expandable metal sleeve part and the well tubular metal structure.

The above objects, together with numerous other objects, advantages and features, which will become evident from the below description, are accomplished by a solution in accordance with the present invention by an annular barrier configured to be arranged on an outer face of a well tubular metal structure for providing zonal isolation in an annulus downhole, comprising:

an annular space enclosed by an enclosure, the enclosure having a first outer face configured to face away from the outer face of the well tubular metal structure and a second outer face configured to face the outer face of the well tubular metal structure when the annular barrier is arranged around the well tubular metal structure, wherein the annular barrier further comprises a first inner annular sealing element arranged on the second outer face configured to seal between the enclosure and the well tubular metal structure.

The enclosure may comprise a first expandable metal sleeve part and a second expandable metal sleeve part, the first outer face of the enclosure is the outer face of the first expandable metal sleeve part and the second outer face of the enclosure is the outer face of the second expandable metal sleeve part.

Furthermore, the enclosure may have a toroid-like shape.

Also, the enclosure may be made as one piece.

Thus, the enclosure may be made as a monolithic whole.

The annular barrier may be a hydraulic expanded annular barrier.

The hydraulic expanded annular barrier may be expanded by hydraulic fluid from within the well tubular metal structure.

Thus, the annular barrier may not be a mechanically expanded annular barrier, such as using ratchets.

Furthermore, each of the first expandable metal sleeve part and the second expandable metal sleeve part may have a first end part, an intermediate part, and a second end part.

Moreover, the enclosure may have a first end part, an intermediate part, and a second end part.

The intermediate part facing the well tubular metal structure may abut the outer face of the well tubular metal structure and the end parts may have a distance to the outer face at least in the expanded position of the annular barrier.

Furthermore, the first inner annular sealing element may be arranged on the intermediate part.

In addition, the first inner annular sealing element may be arranged between the intermediate part and the outer face of the well tubular metal structure.

In one embodiment, the annular barrier may have a first position when the annular barrier is arranged in an unexpanded condition on the well tubular metal structure, a second position where the annular space is expanded to energise the sealing ability of the first inner annular sealing element, a third position in which the annular barrier is arranged downhole, and a fourth position in which the annular barrier is plastic deformably expanded to abut the wall of a borehole or another tubular structure providing zonal isolation.

In another embodiment, the annular barrier may have a first position when the annular barrier is arranged in an unexpanded condition on the well tubular metal structure, a second position where the annular space is elastically expanded to energise the sealing ability of the first inner annular sealing element, a third position in which the annular barrier is arranged downhole, and a fourth position in which the annular barrier is plastic deformably expanded providing zonal isolation.

Thus, the annular space may have been pressurised to the first pressure in the second position and the annular space may have been pressurised to the second pressure higher than the first pressure in the second position.

In addition, the annular barrier according to the present invention may further comprise a second inner annular sealing element arranged on the outer face of the second expandable metal sleeve part configured to seal between the second expandable metal sleeve part and the well tubular metal structure.

Moreover, the first inner annular sealing element may be arranged at a distance from the second inner annular sealing element, and the second expandable metal sleeve part may have an opening between the first inner annular sealing element and the second inner annular sealing element.

Additionally, the enclosure may have an opening between the first inner annular sealing element and the second inner annular sealing element.

Furthermore, a burstable element, such as a burst disc, may be arranged in the opening.

Also, the burstable element may burst at a burst pressure.

In addition, the second expandable metal sleeve part may deform at a first pressure.

Moreover, the burst pressure may be higher than the first pressure.

Additionally, the first expandable metal sleeve part may deform at a second pressure.

Further, the burst pressure may be lower than the second pressure.

In addition, the first expandable metal sleeve part and the second expandable metal sleeve part may be made in one piece as a monolithic whole.

Furthermore, the annular barrier may be made by three-dimensional printing into one piece.

Also, the one piece comprising the first expandable metal sleeve part and the second expandable metal sleeve part may be made by three-dimensional printing into one piece.

Moreover, the annular barrier may have a toroid-like shape.

Additionally, the annular barrier may have a toroid-like shape having an elongated cross-section.

Further, the annular barrier may have an elongated cross-sectional shape in an unexpanded condition when seen in cross-section along the well tubular metal structure.

In addition, the first expandable metal sleeve part and the second expandable metal sleeve part may be two sleeves welded together enclosing the annular space.

Also, the first expandable metal sleeve part and the second expandable metal sleeve part may have ends and may be two sleeves welded together at the ends.

Moreover, the first expandable metal sleeve part and the second expandable metal sleeve part may be connected at the ends, e.g. by welding.

Furthermore, the second expandable metal sleeve part may have a smaller thickness than that of the first expandable metal sleeve part.

Additionally, the first expandable metal sleeve part may have a first thickness and the second expandable metal sleeve part may have a second thickness, the second thickness being smaller than the first thickness.

Further, the second expandable metal sleeve part may be made of a material having a higher ductability than that of the first expandable metal sleeve part.

Also, each of the first expandable metal sleeve part and the second expandable metal sleeve part may have a first end part, an intermediate part, and a second end part, and the end parts may have a higher thickness than that of the intermediate parts.

In addition, the end parts of each sleeve part may be expanded less than that of the intermediate part during expansion of the annular barrier.

Moreover, the end parts may have a third thickness.

Additionally, the annular barrier according to the present invention may further comprise a port for energising the inner annular sealing elements when mounting the annular barrier on the well tubular metal structure.

Furthermore, the port may be arranged in one of the end parts.

In addition, the port may have an intermediate position allowing fluid to flow into the annular space to energise the inner annular sealing elements at a first pressure when mounting the annular barrier on the well tubular metal structure.

Moreover, the port may have an intermediate position allowing fluid to flow into the annular space to expand at least part of the second expandable metal sleeve part at a first pressure when mounting the annular barrier on the well tubular metal structure.

Additionally, the port may have a final position disconnecting fluid communication to the annular space.

Furthermore, the port may be in fluid communication with the annular space.

Further, the port may be arranged near the first end of the expandable metal sleeve parts.

Also, the port may be provided by a tube welded into the welding of the ends of the expandable metal sleeve parts.

Moreover, the annular barrier according to the present invention may further comprise a flange for fastening of the annular barrier to the well tubular metal structure.

In addition, one of the expandable metal sleeve parts may have the flange.

Furthermore, a projection may be formed by one of the expandable metal sleeve parts being longer than the other.

Additionally, the annular barrier according to the present invention may further comprise at least one outer annular sealing element arranged on the outer face of the first expandable metal sleeve part.

Moreover, the annular barrier according to the present invention may further comprise one outer annular sealing element arranged on the outer face of the enclosure.

In addition, the expandable metal sleeve parts may have at least two projections on the outer face forming a groove in which the annular sealing element is arranged.

Also, the first expandable metal sleeve part and the second expandable metal sleeve part may not be welded or crimped onto the outer face of the well tubular metal structure.

Furthermore, the first expandable metal sleeve part and the second expandable metal sleeve part may be slidably along an axial extension of the well tubular metal structure.

Moreover, the first expandable metal sleeve part and the second expandable metal sleeve part may not be directly fastened to the well tubular metal structure.

Further, the annular sealing element and a split ring-shaped retaining element may be arranged in the groove for forming a back-up of the annular sealing element and the split ring-shaped retaining element may have more than one winding, so that when the expandable metal sleeve part is expanded, the split ring-shaped retaining element partly unwinds.

Additionally, the split ring-shaped retaining element may ensure that the annular sealing element is maintained in the longitudinal extension of the downhole expandable tubular even when it is being expanded, so that the annular sealing element retains its intended position and the sealing properties of the downhole expandable tubular are enhanced. The sealing element may withstand a higher pressure on the side where the split ring-shaped retaining element is positioned, since the split ring-shaped retaining element functions as a back-up and support system for the sealing element.

Furthermore, the split ring-shaped retaining element may be a split ring.

Also, an intermediate element may be arranged between the split ring-shaped retaining element and the sealing element.

Moreover, said split ring-shaped retaining element may partly overlap the intermediate element.

Further, the split ring-shaped retaining element and the intermediate element may be arranged in an abutting manner to the sealing element, so that at least one of the split ring-shaped retaining elements and the intermediate element may abut the sealing element.

Additionally, the sealing element may be made of an elastomer, rubber, polytetrafluoroethylene (PTFE) or another polymer.

Also, the intermediate element may be made of a Polytetrafluoroethylene (PTFE) as a base material with for instance brass, carbon and/or stainless steel contained therein.

Furthermore, the expandable metal sleeve parts may be made from one tubular metal blank.

Thus, the expandable metal sleeve parts may be made as a monolithic whole.

In addition, the blank may be made by centrifugal casting or spin casting.

Moreover, the projections may be provided by machining the blank.

Further, the expandable metal sleeve parts may be machined from the blank by means of grinding, milling, cutting, or lathering, or by means of a similar method.

Additionally, the sealing element when arranged in the groove may provide a space in which a circumferential resilient element may be arranged.

Furthermore, the circumferential resilient element may be a coiled spring.

Also, the sealing element may be made of metal.

Moreover, the circumferential resilient element may be made of metal.

In addition, the present invention relates to a downhole system comprising a well tubular metal structure having an aperture, and at least one annular barrier mentioned above, wherein the at least one annular barrier is arranged so that the aperture is arranged between the first inner sealing element and the second inner sealing element.

Further, the downhole system according to the present invention may further comprise a plurality of annular barriers.

Additionally, the annular barriers may be arranged abutting each other. Thus, the annular barriers may be arranged back-to-back.

Moreover, several annular barriers may be arranged on one joint, i.e. arranged on the same tubing part which tubing parts when mounted together forms the well tubular metal structure.

Also, at least two annular barriers may be connected via a tube or a hydraulic control line.

In addition, at least one of the annular barriers may be fluidly connected to surface or seabed via the hydraulic control line.

Furthermore, the downhole system according to the present invention may comprise at least one centraliser for fastening the annular barrier along the outer face of the well tubular metal structure.

Moreover, the annular barrier may comprise an opening opposite an aperture in the well tubular metal structure so that an annular volume may be formed between the first inner annular sealing element and the second inner annular sealing element.

Also, the annular barrier may comprise a port having allowing fluid to flow into the annular space to expand at least part of the second expandable metal sleeve part at a first pressure when mounting the annular barrier on the well tubular metal structure.

Additionally, the port has a final position disconnecting fluid communication to the annular space.

Additionally, the present invention relates to a method of arranging an annular barrier as mentioned above on the outer face of the well tubular metal structure mounted from tubing parts or a joint for providing zonal isolation in an annulus downhole, comprising:

sliding the annular barrier onto and along one of the tubing parts or joints of the well tubular metal structure, activating the inner annular sealing element(s) by pressurising the annular space so that the second expandable metal sleeve part presses against the outer face of the well tubular metal structure, mounting the tubing part having the annular barrier as part of the well tubular metal structure, inserting the well tubular metal structure into a borehole providing the annulus around the well tubular metal structure, expanding the annular barrier by expanding at least the first expandable metal sleeve part into abutment against a wall of the borehole or another well tubular metal structure isolating one part of the annulus from another part.

Furthermore, the step of sliding according to the present invention may further comprise arranging the opening in the annular barrier opposite the aperture in the well tubular metal structure so that an annular volume may be formed between the first inner annular sealing element and the second inner annular sealing element.

Also, the step of activating according to the present invention may further comprise bursting the burstable element after the inner annular sealing elements have been activated.

Moreover, the method before the step of activating the inner sealing element(s) according to the present invention may further comprise fluidly connecting the annular space with a pump via the port.

Additionally, the method after the step of activating the inner sealing element(s) according to the present invention may further comprise disconnecting the pump.

Further, the method according to the present invention may further comprise plugging the port, e.g. with a plug or with welding.

Furthermore, the step of expanding the annular barrier may be performed by pressurising at least a part of the well tubular metal structure, entering the pressurised fluid through the aperture into the annular volume and further into the annular space via the opening.

In addition, activating the first inner annular sealing element and the second inner annular sealing element provides the annular volume, which is then used as a fluid channel for fluidly connecting the aperture with the opening.

Also, the method according to the present invention may further comprise perforating the annular barrier.

Finally, the method according to the present invention may further comprise perforating the annular barrier and the well tubular metal structure by means of a perforation tool from within the well tubular metal structure.

Figure 1B:
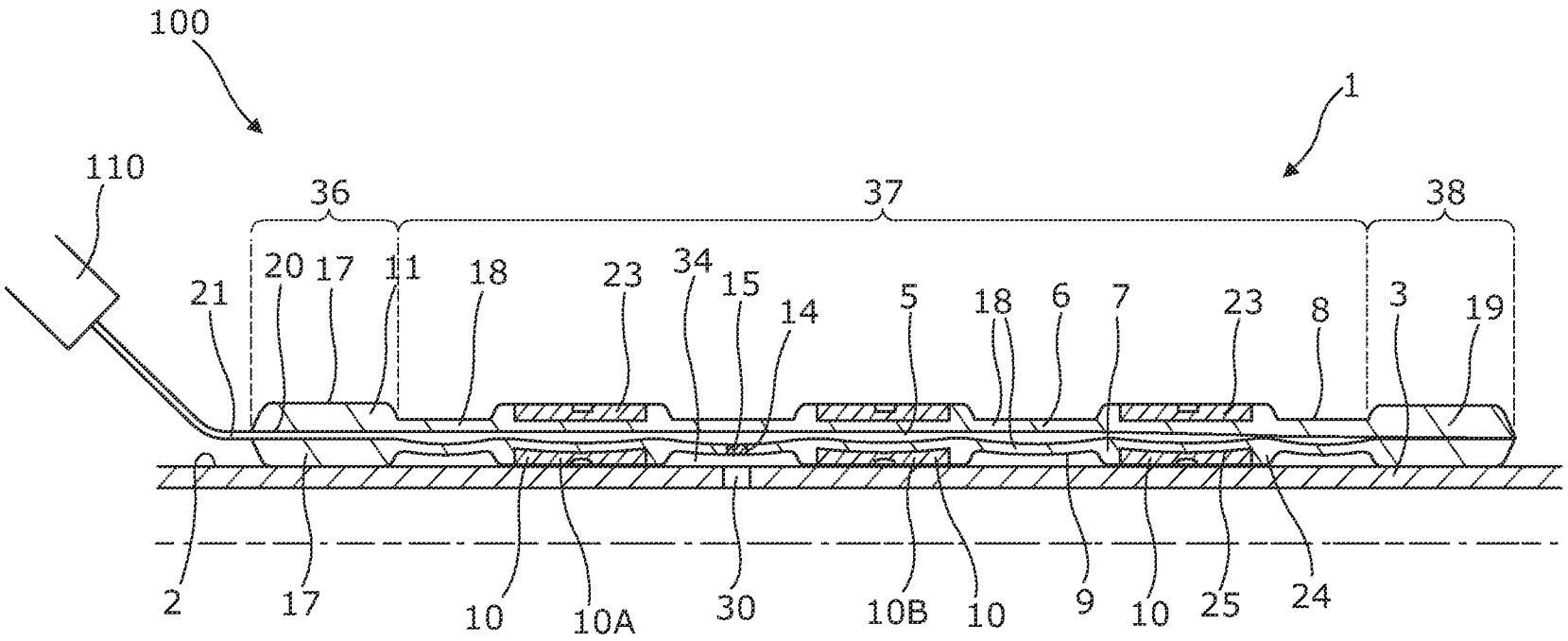
Figure 1C:
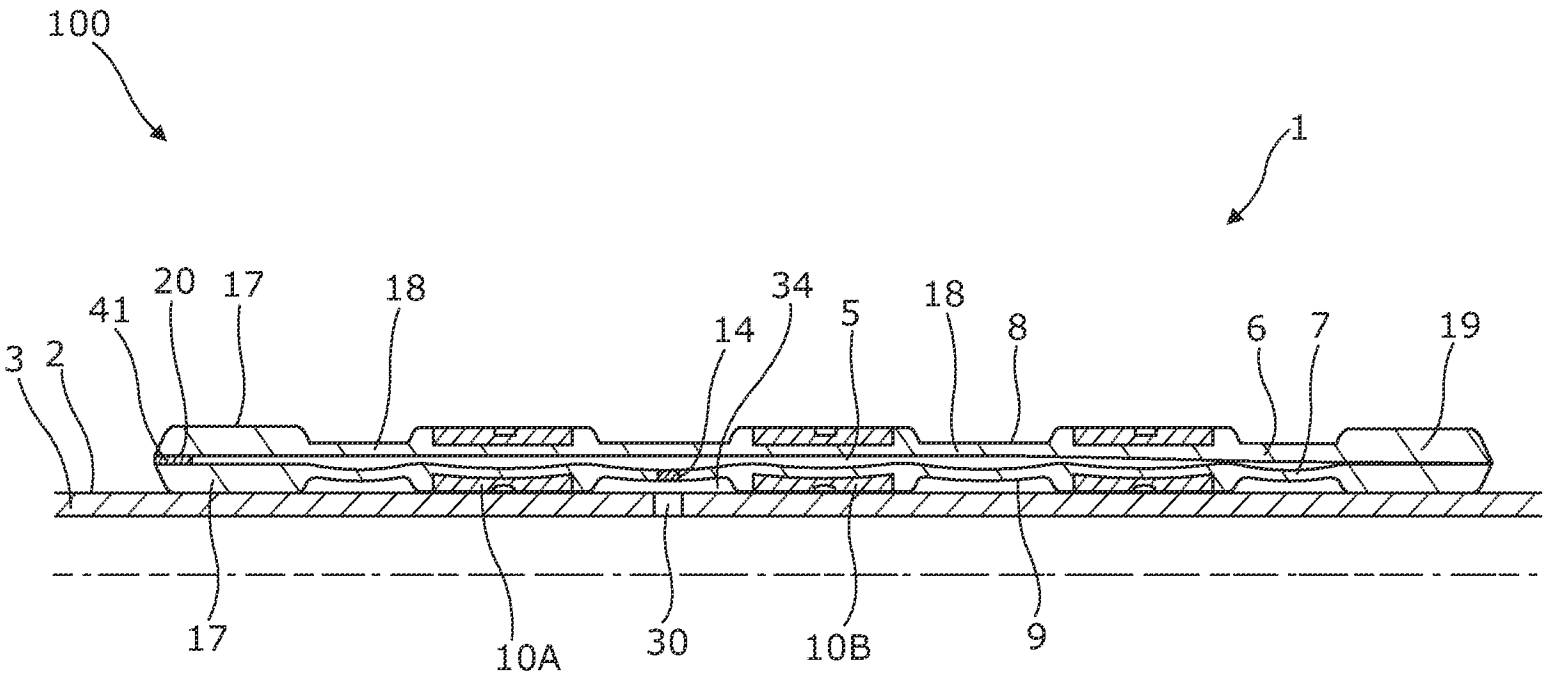
Figure 1D:
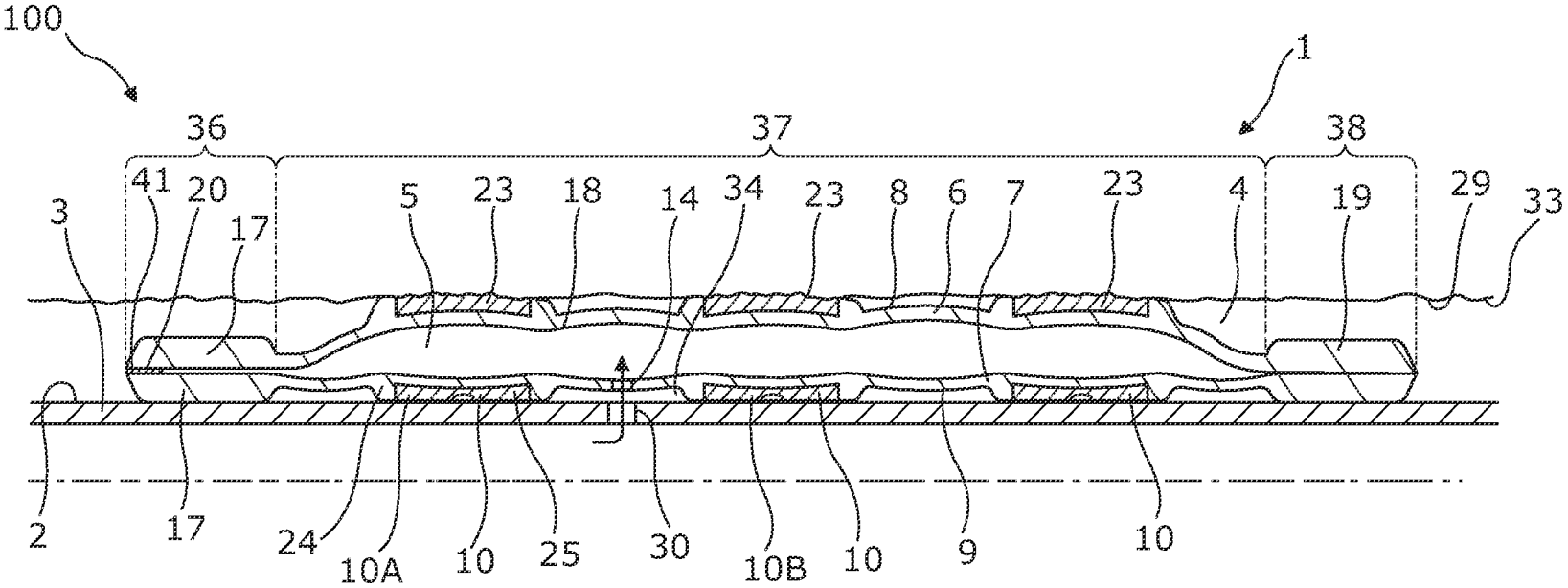
Figure 2:
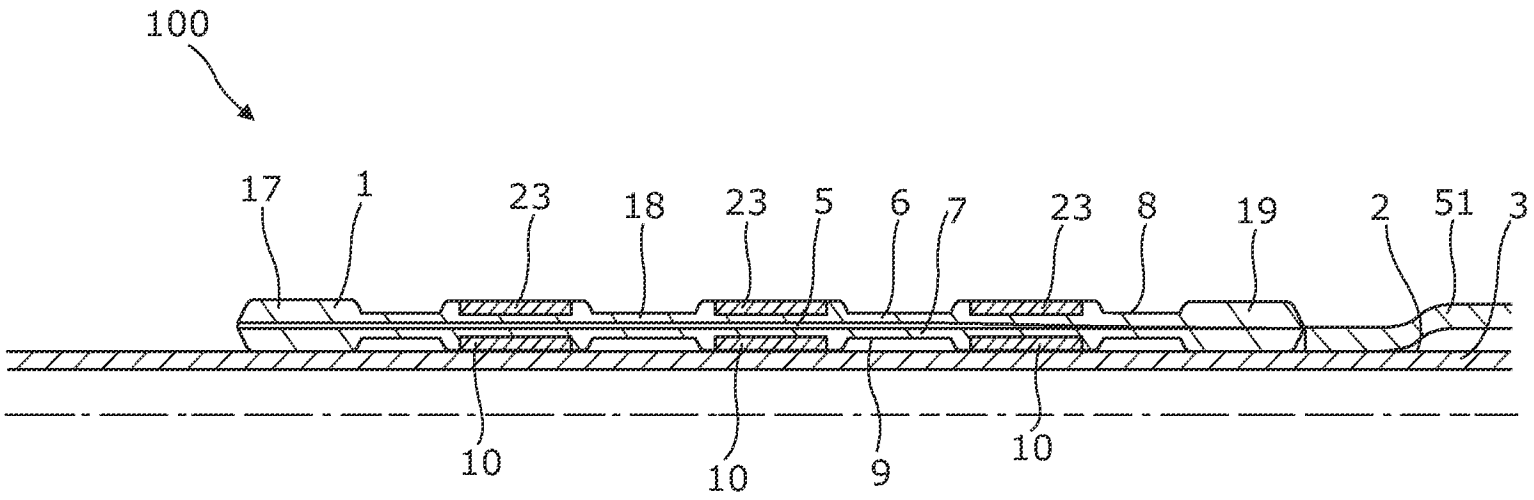
Figure 3:
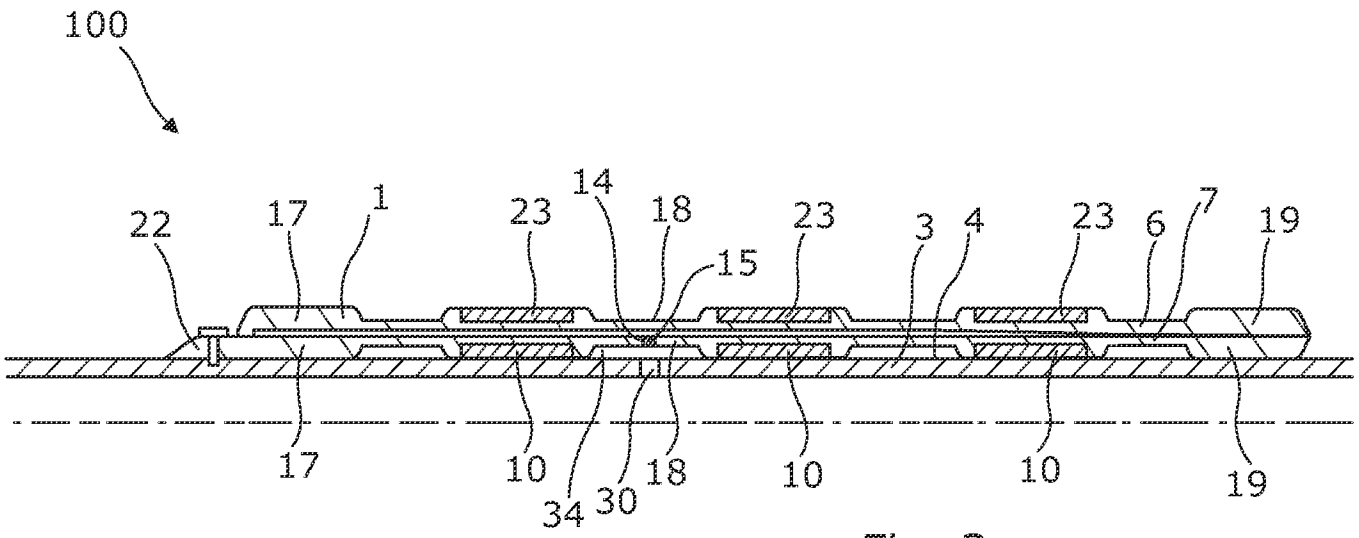
Figure 4:
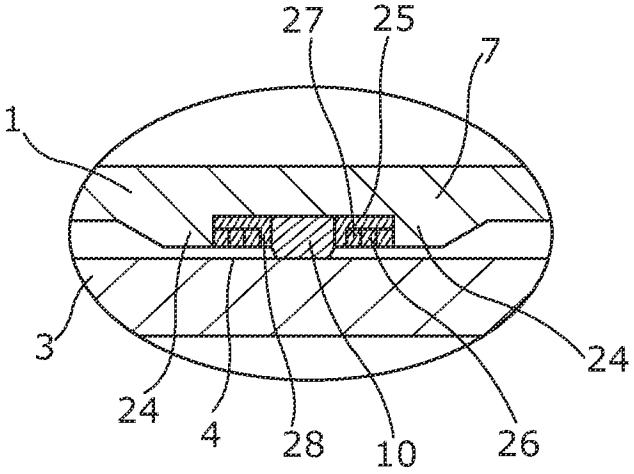
Figure 5:
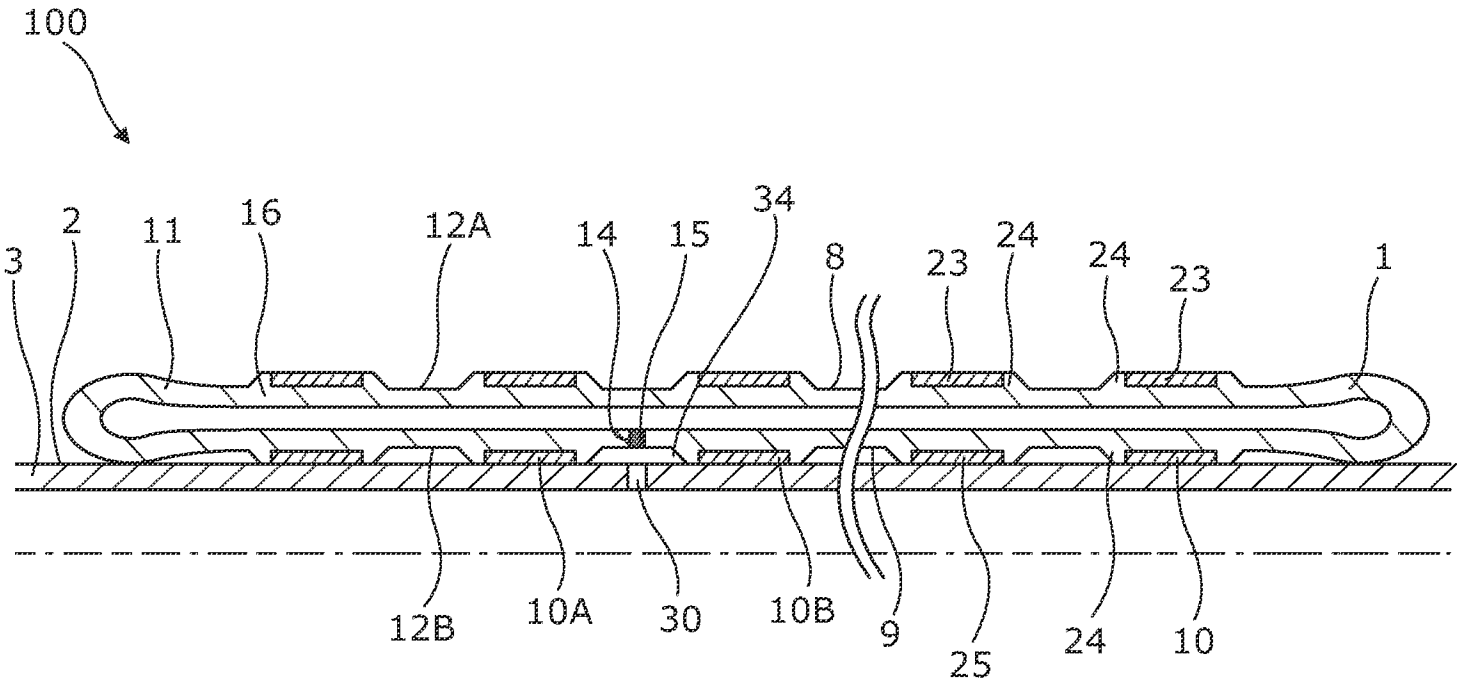
Figure 6:
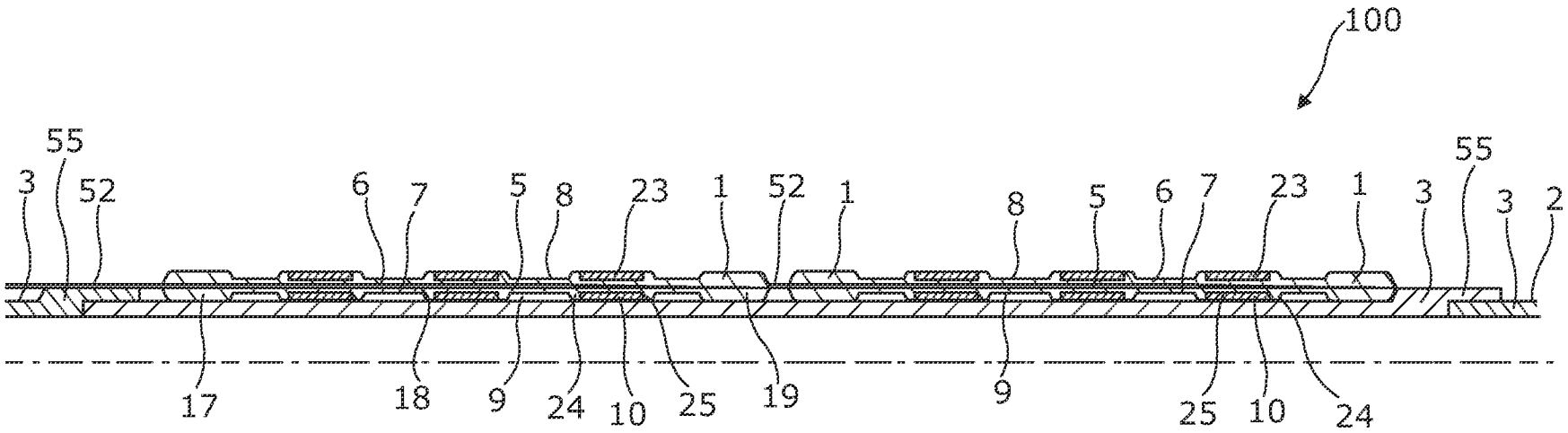
Figure 7:
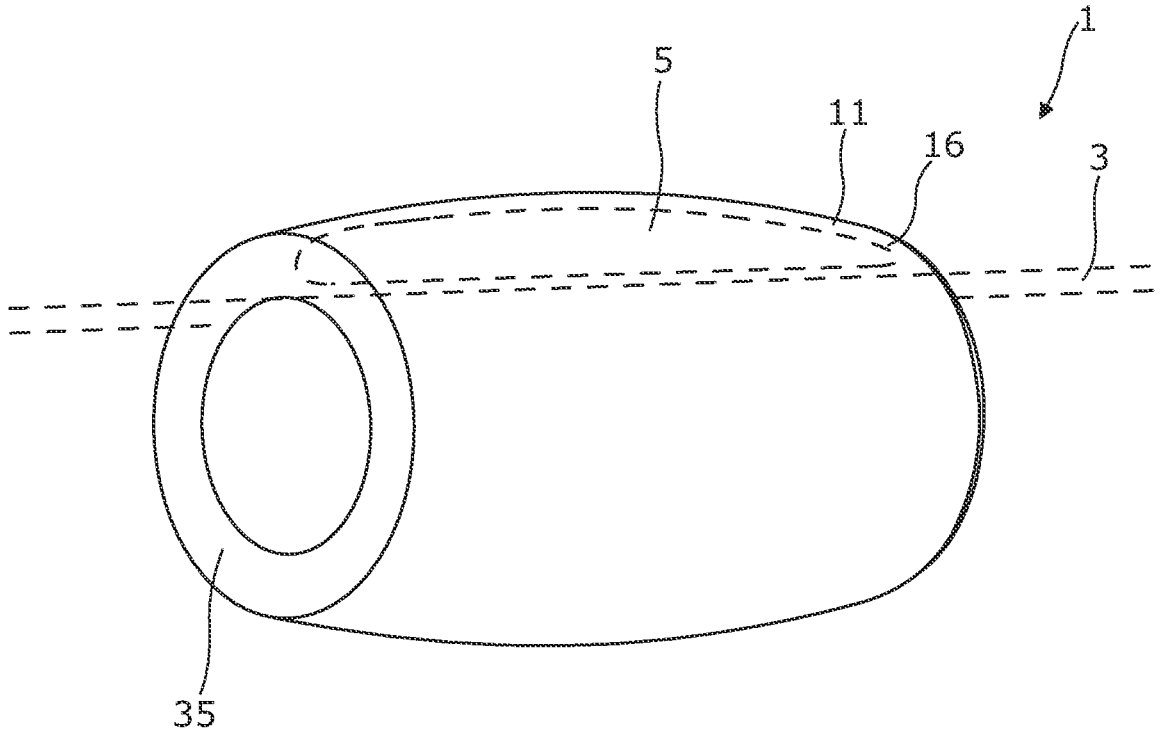
Figure 8:
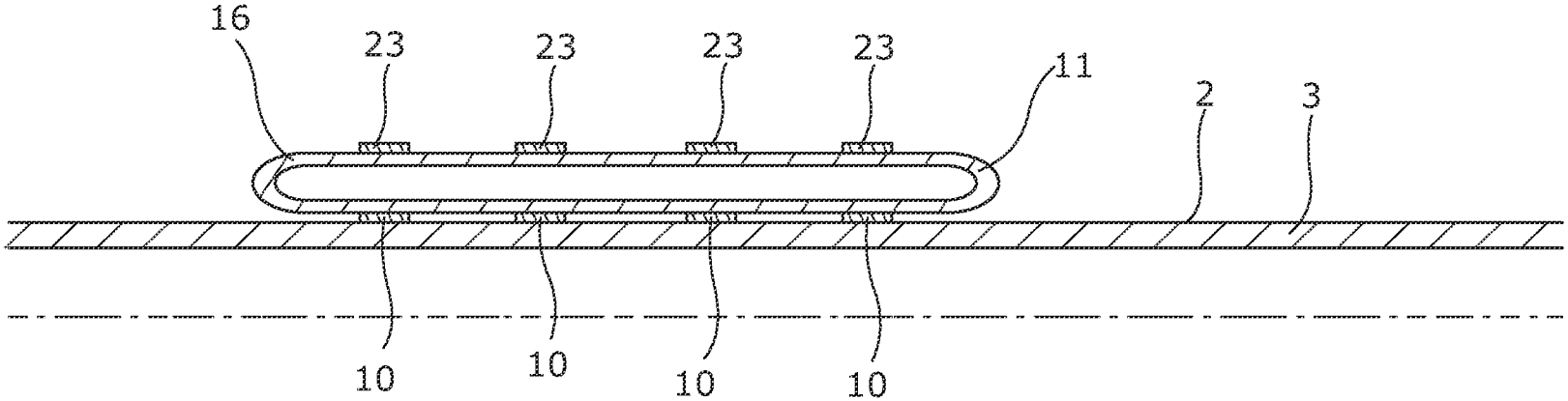

The invention and its many advantages will be described in more detail below with reference to the accompanying schematic drawings, which for the purpose of illustration show some non-limiting embodiments and in which:

FIG. 1A shows a cross-sectional view of an unexpanded and inactivated annular barrier arranged around a well tubular metal structure, FIG. 1B shows a cross-sectional view of the annular barrier of FIG. 1A in an activated position, FIG. 1C shows a cross-sectional view of the annular barrier of FIG. 1A in the activated position and in which the burstable element has been burst, FIG. 1D shows a cross-sectional view of the annular barrier of FIG. 1A in an expanded position providing a zonal isolation between the wall of the borehole and the well tubular metal structure, FIG. 2 shows a cross-sectional view of part of a downhole system having a centraliser, FIG. 3 shows a cross-sectional view of another annular barrier having a flange, FIG. 4 shows a cross-sectional view of part of an annular barrier having an annular sealing element, FIG. 5 shows a cross-sectional view of a one piece annular barrier having sealing elements, FIG. 6 shows a cross-sectional view of another downhole system having two annular barriers on one joint, FIG. 7 shows a perspective view of a one piece annular barrier having a toroid-like shape, and FIG. 8 shows a cross-sectional view of an annular barrier having a toroid-like shape and annular sealing elements.

All the figures are highly schematic and not necessarily to scale, and they show only those parts which are necessary in order to elucidate the invention, other parts being omitted or merely suggested.

FIG. 1A shows an annular barrier 1 which is arranged on an outer face 2 of a well tubular metal structure 3 for providing zonal isolation in an annulus 4 (shown in FIG. 1D) downhole. The annular barrier 1 comprises an annular space 5 defined by a first expandable metal sleeve part 6 and a second expandable metal sleeve part 7. The first expandable metal sleeve part 6 has an outer face 8 facing away from the outer face 2 of the well tubular metal structure 3 when the annular barrier 1 is arranged around the well tubular metal structure, and the second expandable metal sleeve part 7 has an outer face 9 facing the outer face 2 of the well tubular metal structure 3 when the annular barrier 1 is arranged around the well tubular metal structure. The annular barrier 1 further comprises a first inner annular sealing element 10, 10A arranged on the outer face 9 of the second expandable metal sleeve part 7 for providing a seal between the second expandable metal sleeve part 7 and the well tubular metal structure 3.

The annular barrier 1 further comprises a second inner annular sealing element 10, 10B arranged on the outer face 9 of the second expandable metal sleeve part 7 for providing a seal between the second expandable metal sleeve part 7 and the well tubular metal structure 3. The first inner annular sealing element 10, 10A is arranged at a distance d from the second inner annular sealing element 10, 10B, and the second expandable metal sleeve part 7 has an opening 14 being arranged between the first inner annular sealing element 10, 10A and the second inner annular sealing element 10, 10B. The annular barrier 1 further comprises a burstable element 15, such as a burst disc, arranged in the opening 14.

In FIG. 1C, the first expandable metal sleeve part 6 and the second expandable metal sleeve part 7 are two sleeves welded together enclosing the annular space 5. The first expandable metal sleeve part 6 and the second expandable metal sleeve part 7 have ends (at the end parts 17 and 19) and the two sleeves are welded together at the ends 17, 19. The first expandable metal sleeve part 6 has a first thickness $t_1$ and the second expandable metal sleeve part 7 has a second thickness $t_2$, and the second thickness $t_2$ is smaller than the first thickness $t_1$, so that the second expandable metal sleeve part 7 can be expanded radially inwards towards the outer face 2 of the well tubular metal structure 3, as shown in FIG. 1B, at a lower pressure than the pressure needed for expanding the first expandable metal sleeve part 6 radially outwards.

In FIG. 1B, each of the first expandable metal sleeve part and the second expandable metal sleeve part may have a first end part 36, an intermediate part 37, and a second end part 38. Thus, the enclosure has a first end part 36, an intermediate part 37, and a second end part 38. As shown in FIG. 1B, the intermediate part facing the well tubular metal structure abuts the outer face of the well tubular metal structure and is slightly expanded by a first pressure to energise the sealing ability of the first inner annular sealing element. The end parts remain unexpanded or have a distance to the outer face at least in the expanded position of the annular barrier. The first inner annular sealing element is arranged on the outer face of the intermediate part 37 between the intermediate part and the outer face of the well tubular metal structure.

In FIG. 1A, the annular barrier has a first position when the annular barrier is arranged in an unexpanded condition on the well tubular metal structure, and in FIG. 1B the annular barrier has a second position where the annular space is expanded to energise the sealing ability of the first inner annular sealing element, and a third position in which the annular barrier is arranged downhole, and as shown in FIG. 1D a fourth position in which the annular barrier is plastic deformably expanded to abut the wall of a borehole providing zonal isolation. Although not shown, the annular barrier could also abut the wall of another tubular structure.

Thus, the annular barrier has a first position when the annular barrier is arranged in an unexpanded condition on the well tubular metal structure, a second position where the annular space is elastically or plastic expanded at a first pressure to energise the sealing ability of the first inner annular sealing element, and a final position in which the annular barrier is plastic deformably expanded providing zonal isolation. Thus, the annular space has been pressurised to the first pressure in the second position and the annular space has been pressurised to the second pressure higher than the first pressure in the second position.

In another embodiment, the second expandable metal sleeve part 7 is made of a material having a higher ductability than that of the first expandable metal sleeve part 6 so that the second expandable metal sleeve part 7 can be expanded radially inwards towards the outer face 2 of the well tubular metal structure 3, as shown in FIG. 1B, at a lower pressure than the pressure needed for expanding the first expandable metal sleeve part 6 radially outwards.

In FIG. 1A, the annular barrier 1 further comprises a port 20 for energising the inner annular sealing elements 10, 10A, 10B when mounting the annular barrier 1 on the well tubular metal structure 3. The port 20 is in fluid communication with the annular space 5 and is arranged near the first end of the expandable metal sleeve parts. The port 20 is fluidly connected to a pump 110 via a tube 21 which may be welded into the welding of the ends of the expandable metal sleeve parts 6, 7. The inner annular sealing elements 10, 10A, 10B are energised by the pump 110 increasing the pressure inside the annular barrier 1 to a first pressure at which the second expandable metal sleeve part 7 deforms and thereby pressing the outer face 2 of the well tubular metal structure 3 and squeezes the inner annular sealing elements 10, 10A, 10B and thereby energising the inner annular sealing elements to provide a sufficient seal to the outer face 2 of the well tubular metal structure 3, as shown in FIG. 1B. The burstable element 15 is set to burst at a burst pressure which is higher than the first pressure, and by slightly increasing the pressure in the annular space 5, the burstable element bursts as shown in FIG. 1C and then the pump is disconnected and the port 20 is plugged by a plug 41 or by welding. The annular barrier 1 is now mounted onto the well tubular metal structure 3 and is ready to be submerged into the borehole 4 of the well. When arranged in the borehole 29 at the intended position, the annular barrier is expanded by pressurising at least part of the well tubular metal structure 3 from within as shown in FIG. 1D, and then the first expandable metal sleeve part 6 also deforms radially outwards until abutting against the wall of the borehole as shown in FIG. 1D or until abutting against the wall of another well tubular metal structure (not shown). The first expandable metal sleeve part 6 deforms at a second pressure. The burst pressure is lower than the second pressure. The fluid used for pressuring at least part of the well tubular metal structure 3 may be well fluid, seawater, etc.

As shown in FIGS. 1A and 1B, the port has an intermediate position allowing fluid to flow into the annular space to energise the inner annular sealing elements at a first pressure when mounting the annular barrier on the well tubular metal structure.

Thus, in the intermediate position, fluid is allowed to flow into the annular space to expand at least the intermediate part of the second expandable metal sleeve part at the first pressure when mounting the annular barrier on the well tubular metal structure. The port has a final position disconnecting fluid communication to the annular space, as shown in FIG. 1C.

In FIGS. 1A-1D, each of the first expandable metal sleeve part 6 and the second expandable metal sleeve part 7 have a first end part 17, an intermediate part 18 and a second end part 19, and the end parts have a higher thickness than that of the intermediate parts. The end parts 17, 19 of each sleeve part are expanded less than that of the intermediate part during expansion of the annular barrier, as shown in FIG. 1D. As shown in FIG. 1A, the end parts have a third thickness $t_3$ which is larger than both the first thickness $t_1$ and the second thickness $t_2$.

As can be seen in FIGS. 1A-1D, the annular barrier 1 further comprises at least one outer annular sealing element 23 arranged on the outer face 8 of the first expandable metal sleeve part 6 in order to provide a proper seal against the wall of the borehole or another well tubular metal structure (not shown). The expandable metal sleeve parts 6, 7 have a plurality of two projections 24 on the outer face forming a groove 25 in which the inner annular sealing element 10 and/or the outer annular sealing element 23 is arranged.

By having the inner annular sealing elements 10 on the outer face 9 facing the outer face of the well tubular metal structure around which the annular barrier is arranged, welding of the annular barrier to the well tubular metal structure is avoided. Thus, the first expandable metal sleeve part 6 and the second expandable metal sleeve part 7 are not welded or crimped onto the outer face 2 of the well tubular metal structure 3. The annular barrier 1 is simply slided onto a joint or a tubular part forming the well tubular metal structure. Thus, the first expandable metal sleeve part and the second expandable metal sleeve part are slidably along an axial extension of the well tubular metal structure and are not directly fastened to the well tubular metal structure. The sealing ability of the annular barrier is thereby not dependent on the welding, and an improved annular barrier, which avoids the risk of the welding process damaging the sealing ability of the annular barrier, is provided.

In FIG. 2, the downhole system 100 having the well tubular metal structure 3 and the annular barrier 1 further comprises a centraliser 51 which rests against the casing collar and thereby secures the annular barrier in the intended position even when running the well tubular metal structure in-hole. The downhole system may comprise several centralisers 51 for maintaining the annular barrier 1 in position.

In FIG. 5, the annular barrier 1 configured to be arranged on an outer face 2 of a well tubular metal structure for providing zonal isolation in an annulus downhole, comprises an annular space enclosed by an enclosure 11, the enclosure having a first outer face 12A configured to face away from the outer face 2 of the well tubular metal structure 3 and a second outer face 9, 12B configured to face the outer face 2 of the well tubular metal structure when the annular barrier is arranged around the well tubular metal structure, wherein the annular barrier further comprises a first inner annular sealing element 10 arranged on the second outer face 9, 12B configured to seal between the enclosure 11 and the well tubular metal structure 3. The enclosure 11 is made as one piece 16 and thus has a toroid-like shape. The enclosure has a second inner annular sealing element 10, 10B at a distance to the first inner annular sealing element 10, 10A forming an annular volume 34 between the inner annular sealing elements, the second expandable metal sleeve part 7 and the outer face 2 of the well tubular metal structure. An opening 14 is arranged in the part of the enclosure 11 facing the well tubular metal structure 3 between the first inner annular sealing element 10, 10A and the second inner annular sealing element 10, 10B and opposite the annular volume 34. The opening 14 is arranged opposite an aperture 30 in the well tubular metal structure, so that the aperture is in fluid communication with the annular volume 34. A burstable element 15 is arranged in the opening 14 as explained in relation to FIG. 1A and functions in the same way.

Thus, the first expandable metal sleeve part 6 and the second expandable metal sleeve part 7 can be made in one piece 16 as shown in FIG. 5 in that the enclosure 11 comprises the first expandable metal sleeve part 6 and the second expandable metal sleeve part 7, and the first outer face 12A of the enclosure 11 is the outer face 8 of the first expandable metal sleeve part 6 and the second outer face 12B of the enclosure 11 is the outer face 9 of the second expandable metal sleeve part 7. The enclosure comprises the first expandable metal sleeve part 6 and the second expandable metal sleeve part 7 but these parts are not separate parts but only parts on the one piece.

The annular barrier 1 of FIG. 5 is made by three-dimensional printing into one piece as shown in FIG. 7 having a toroid-like shape 35. The annular barrier has a toroid-like shape, having an elongated cross-sectional shape in an unexpanded condition when seen in cross-section along the well tubular metal structure as shown in the cross-sectional view of FIG. 8. The annular barrier of FIG. 7 is shown as a blank before the expandable metal sleeve parts are machined by means of grinding, milling, cutting, or lathering, or by means of a similar method for forming the projections and grooves in which the annular sealing elements are arranged as shown in FIG. 8.

In FIG. 3, the second expandable metal sleeve part 7 further comprises a flange 22 for fastening the annular barrier 1 to the well tubular metal structure 3, e.g. by means of a screw. The flange is formed by the second expandable metal sleeve part 7 being longer than the first expandable metal sleeve part 6.

The annular sealing elements 10, 23 may have a variety of shapes; one of them is shown in FIG. 4 where the annular sealing element and a split ring-shaped retaining element 26 are arranged in the groove for forming a back-up for the annular sealing element. The split ring-shaped retaining element has more than one winding 27, so that when the expandable metal sleeve parts 6, 7 are expanded, the split ring-shaped retaining element partly unwinds. Hereby, it is obtained that the split ring-shaped retaining element ensures that the annular sealing element is maintained in the longitudinal extension of the downhole expandable tubular even when it is being expanded, so that the sealing element retains its intended position and the sealing properties of the downhole expandable tubular are enhanced. The sealing element 10, 23 may withstand a higher pressure on the side where the split ring-shaped retaining element is positioned, since the split ring-shaped retaining element functions as a back-up and support system for the sealing element. Thus, the split ring-shaped retaining element may be a split ring. The annular barrier may further comprise an intermediate element 28 being arranged between the split ring-shaped retaining element and the sealing element. The split ring-shaped retaining element may partly overlap the intermediate element. Furthermore, the split ring-shaped retaining element and the intermediate element may be arranged in an abutting manner to the sealing element, so that at least one of the split ring-shaped retaining elements and the intermediate element may abut the sealing element. The sealing element may be made of an elastomer, rubber, polytetrafluoroethylene (PTFE) or another polymer. The intermediate element may be made of a Polytetrafluoroethylene (PTFE) as a base material with for instance brass, carbon and/or stainless steel contained therein.

FIG. 6 discloses a downhole system 100 comprising two annular barriers 1 which are arranged abutting each other. Thus, several annular barriers 1 are arranged on one joint, i.e. arranged on the same tubing part, which tubing parts when mounted together form the well tubular metal structure 3. The annular barriers are arranged "back-to-back" without any intermediate connection parts. The two annular barriers are fluidly connected via a tube or a hydraulic control line 52 and the control line extends across the casing collar 55 assembling two joints. The annular barrier closest to the surface may be fluidly connected to the surface or seabed via a hydraulic control line 52 so that the annular barriers can be expanded from surface/seabed via the control line to the first annular barrier and further via the control lines between the annular barriers. Thus, the annular barriers do not have an opening and the well tubular metal structure does not have apertures opposite these openings since the expansion occurs via the control lines arranged outside the well tubular metal structure. In another embodiment, the downhole system comprises more than two annular barriers.

The zonal isolation down the well is provided by arranging an annular barrier 1 on the outer face 2 of the well tubular metal structure 3 mounted from tubing parts or joints by sliding the annular barrier 1 onto and along one of the tubing parts or joints of the well tubular metal structure 3. Then the inner annular sealing element(s) 10, 10A, 10B is activated by pressurising the annular space so that the second expandable metal sleeve part 7 presses against the outer face 2 of the well tubular metal structure 3 before or after the tubing part having the annular barrier 1 is mounted as part of the well tubular metal structure 3. Then, the well tubular metal structure 3 is inserted into a borehole 29 providing the annulus 4 around the well tubular metal structure 3. The well tubular metal structure 3 is lowered into the well until the annular barriers 1 are arranged in the intended positions and then the annular barriers 1 are expanded by pressurising the annular space 5 and thereby expanding at least the first expandable metal sleeve part 6 into abutment against a wall 33 of the borehole or another well tubular metal structure isolating one part of the annulus from another part.

When sliding the annular barrier 1 onto the well tubular metal structure, the opening 14 in the annular barrier is arranged opposite the aperture 30 in the well tubular metal structure 3 so that an annular volume 34 is formed between the first inner annular sealing element 10A and the second inner annular sealing element 10B. When the inner annular sealing elements 10, 10A, 10B have been activated, the annular volume 34 is sealed, except for the aperture 30 in the well tubular metal structure 3, and thus the annular volume 34 can be used for an annular fluid channel fluidly connecting the opening 14 and the aperture 30, and thus the opening and the aperture do not have to be fully aligned since the annular volume will connect them.

When activating the inner annular sealing elements 10, the pressure is slightly increased bursting the burstable element after the inner annular sealing elements have been activated. The activation of the inner sealing element(s) further comprises fluidly connecting the annular space 5 with a pump 110 via the port 20 or via control lines 52. Thus, the pump can be arranged at the seabed or surface. After activating the inner sealing element(s), the pump may be disconnected and the expansion of the annular barrier downhole is performed by pressurising at least part of the well tubular metal structure. If the annular barriers are connected via control lines, the pump is used for expanding the annular barriers downhole.

Before submerging the annular barriers 1, the port 20 is plugged, e.g. with a plug 41 or with welding so that the annular space 5 of the annular barriers 1 can be pressurised. The annular barrier is expanded by pressurising at least a part of the well tubular metal structure 3, entering the pressurised fluid through the aperture into the annular volume 34 and further into the annular space 5 via the opening 14. Thus, activating the first inner annular sealing element 10A and the second inner annular sealing element 10B provide the annular volume 34 which is then used as a fluid channel for fluidly connecting the aperture 30 with the opening 14.

After expanding the annular barriers 1, so that the first expandable metal sleeve part 6 or the outer face 12A of the enclosure 11 abuts the wall 33 of the borehole 29 or another well tubular metal structure (not shown), one or more of the annular barriers may be perforated. Thus, perforation of the annular barrier and the well tubular metal structure may be performed by means of a perforation tool from within the well tubular metal structure.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or well tubular metal structure is meant any kind of pipe, tubing, tubular, liner, string etc. used downhole in relation to oil or natural gas production. A joint is the tubular parts mounted together forming the casing or well tubular metal structure. The joints are typically mounted together by means of casing collars or similar connection elements.

In the event that the well tubular metal structure 3 is not submergible all the way into the another well tubular metal structure or borehole, a downhole tractor can be used to push the well tubular metal structure all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. An annular barrier configured to be arranged on an outer face of a well tubular metal structure for providing zonal isolation in an annulus downhole, comprising:

an annular space defined by a first expandable metal sleeve part and a second expandable metal sleeve part, the first expandable metal sleeve part having an outer face configured to face away from the outer face of the well tubular metal structure and the second expandable metal sleeve part having an outer face configured to face the outer face of the well tubular metal structure when arranged around the well tubular metal structure, wherein at least part of the second expandable metal sleeve part is hydraulically expandable from a non-expanded position to an expanded position that is radially inwards compared to the non-expanded position, by introducing hydraulic fluid into the annular space when the annular barrier is mounted on the well tubular metal structure, and wherein the annular barrier further comprises a first inner annular sealing element arranged on the outer face of the second expandable metal sleeve part configured to seal between the second expandable metal sleeve part and the well tubular metal structure.

2. The annular barrier according to claim 1, further comprising a second inner annular sealing element arranged on the outer face of the second expandable metal sleeve part configured to seal between the second expandable metal sleeve part and the well tubular metal structure.

3. The annular barrier according to claim 2, wherein the first inner annular sealing element is arranged at a distance from the second inner annular sealing element, and the second expandable metal sleeve part has an opening between the first inner annular sealing element and the second inner annular sealing element.

4. The annular barrier according to claim 3, wherein a burstable element, such as a burst disc, is arranged in the opening.

5. The annular barrier according to claim 1, wherein the first expandable metal sleeve part and the second expandable metal sleeve part are made in one piece.

6. The annular barrier according to claim 1, wherein the first expandable metal sleeve part and the second expandable metal sleeve part are two sleeves welded together enclosing the annular space.

7. The annular barrier according to claim 1, wherein the second expandable metal sleeve part has a smaller thickness than that of the first expandable metal sleeve part.

8. The annular barrier according to claim 1, wherein the second expandable metal sleeve part is made of a material having a higher ductility than that of the first expandable metal sleeve part.

9. The annular barrier according to claim 1, wherein each of the first expandable metal sleeve part and the second expandable metal sleeve part has a first end part, an intermediate part and a second end part, and the end parts have a higher thickness than that of the intermediate parts.

10. The annular barrier according to claim 1, further comprising a port for energising the inner annular sealing elements when mounting the annular barrier on the well tubular metal structure.

11. The annular barrier according to claim 10, wherein the port is in fluid communication with the annular space.

12. The annular barrier according to claim 1, further comprising at least one outer annular sealing element arranged on the outer face of the first expandable metal sleeve part.

13. The annular barrier according to claim 1, wherein the expandable metal sleeve parts have at least two projections on the outer face forming a groove in which the annular sealing element is arranged.

14. A downhole system comprising:

a well tubular metal structure having an aperture, and at least one annular barrier according to claim 1, wherein the at least one annular barrier is arranged so that the aperture is arranged between the first inner sealing element and the second inner sealing element.

15. A method of arranging an annular barrier according to claim 1 on the outer face of the well tubular metal structure mounted from tubing parts or a joint for providing zonal isolation in an annulus downhole, comprising:

sliding the annular barrier onto and along one of the tubing parts or joints of the well tubular metal structure, activating the inner annular sealing element(s) by pressurising the annular space so that the second expandable metal sleeve part presses against the outer face of the well tubular metal structure, mounting the tubing part having the annular barrier as part of the well tubular metal structure, inserting the well tubular metal structure into a borehole providing the annulus around the well tubular metal structure, expanding the annular barrier by expanding at least the first expandable metal sleeve part into abutment against a wall of the borehole or another well tubular metal structure isolating one part of the annulus from another part.

16. The annular barrier according to claim 1, wherein:

in the non-expanded position, the at least part of the second expandable metal sleeve part is configured to be spaced a first distance away from the well tubular metal structure, and in the expanded position, the at least part of the second expandable metal sleeve part is configured to be expanded to a second distance away from the well tubular metal structure, the second distance being less than the first distance.

* * * * *